US006997316B2

(12) United States Patent
Sutherland

(10) Patent No.: US 6,997,316 B2
(45) Date of Patent: Feb. 14, 2006

(54) CAN DISPENSING PACKAGE

(75) Inventor: Robert L. Sutherland, Kennesaw, GA (US)

(73) Assignee: Graphic Packaging International, Inc., Marietta, GA (US)

( * ) Notice: Subject to any disclaimer, the term of this patent is extended or adjusted under 35 U.S.C. 154(b) by 87 days.

(21) Appl. No.: 10/402,879

(22) Filed: Mar. 28, 2003

(65) Prior Publication Data

US 2004/0188300 A1 Sep. 30, 2004

(51) Int. Cl.
*B65D 75/00* (2006.01)
*A47F 1/04* (2006.01)

(52) U.S. Cl. ..... 206/427; 221/305

(58) Field of Classification Search ..... 206/427, 206/430, 434; 229/117.13, 122.1, 242; 221/303, 221/305

See application file for complete search history.

(56) References Cited

U.S. PATENT DOCUMENTS

| | | | | |
|---|---|---|---|---|
| 3,356,279 | A | 12/1967 | Root | |
| 4,396,143 | A | 8/1983 | Killy | |
| 4,785,991 | A * | 11/1988 | Schuster | 229/117.13 |
| 5,368,194 | A * | 11/1994 | Oliff et al. | 221/305 |
| 5,622,309 | A | 4/1997 | Matsuda | |
| 6,283,293 | B1 | 9/2001 | Lingamfelter | |
| D459,927 | S | 7/2002 | Flowers | |
| 6,484,903 | B1 * | 11/2002 | Spivey et al. | 221/303 |
| 6,550,615 | B1 | 4/2003 | Lingamfelter | |
| 6,578,736 | B1 * | 6/2003 | Spivey | 221/305 |
| 6,669,083 | B1 | 12/2003 | Bates | |
| 6,715,639 | B1 * | 4/2004 | Spivey | 221/305 |
| 6,789,673 | B1 | 9/2004 | Lingamfelter | |
| 2002/0029991 | A1 | 3/2002 | Lingamfelter | |
| 2002/0070139 | A1 | 6/2002 | Bates | |
| 2002/0185499 | A1 | 12/2002 | Harrelson | |
| 2003/0141313 | A1 | 7/2003 | Bates | |
| 2004/0089575 | A1 | 5/2004 | Lingamfelter | |
| 2004/0099558 | A1 | 5/2004 | Oliff | |
| 2004/0155098 | A1 | 8/2004 | Harrelson | |
| 2004/0188300 | A1 | 9/2004 | Sutherland | |
| 2005/0023170 | A1 | 2/2005 | Lingamfelter | |

* cited by examiner

*Primary Examiner*—Bryon P. Gehman
(74) *Attorney, Agent, or Firm*—Womble Carlyle Sandridge & Rice, PLLC

(57) ABSTRACT

The carton is provided for carrying cylindrical containers, such as cans in three or more layers and having open ends at the top and bottom of each end of the carton. A dispenser flap is formed by zigzag tear lines in the exiting end of the carton. The carton is constructed so that the ends of a can adjacent the exiting end of the carton are exposed and can be grasped by a person pulling the can forward or up and commencing the tear line forming the flap. Preferable this tear line is of a zigzag configuration, or step format with interruptions in the riser. Cut tear lines in the step permit the controlled tearing of the tear line.

50 Claims, 4 Drawing Sheets

CAN DISPENSING PACKAGE

BACKGROUND OF THE INVENTION

1. Field of the Invention

The present invention relates generally to a partially enclosed paperboard carton capable of enclosing cylindrical containers, such as cans, which carton has a unique dispensing feature that allows the containers to be utilized as an opening device for the dispenser and permits the containers to be rolled out of the carton without destroying the structural integrity of the carton.

2. Background

Fully enclosed cartons capable of enclosing cans have been used in the past that have a feature for dispensing the cans one at a time. Dispenser sections have been provided at various locations within these cartons depending upon the design. Many of these dispensers tend to let all of the containers roll out once they have been opened. Many of the cartons with dispensers are fully enclosed. It would be desirable to have a carton with a dispenser that provided some exposure of the containers inside for advertising purposes.

3. Prior Art

U.S. Pat. No. 3,265,283 to Farquhar discloses a fully enclosed carton having a dispenser for dispensing the enclosed cans. The end wall of the carton has a dispensing flap which can be folded down upon opening. An aperture formed by the flap extends into the sidewalls to permit grasping of the can to withdraw it from the carton. When the flap is opened, the cans are held in the carton by an arcuate flap portion extending downwardly in the end wall into the center of the aperture. The structural integrity of this carton is compromised because the entire bottom end of the carton is opened.

U.S. Pat. No. 4,364,509 to Holly, Jr. et al. also discloses a fully enclosed carton with a dispenser in one of the end walls. This dispenser is likewise formed in the end wall by tearing out an end flap and lowering it into proper position. Expansion slits are provided in the sidewall for the user's fingers to grasp the ends of the existing can.

SUMMARY OF THE INVENTION

It is an object of this invention to develop a dispenser for dispensing cylindrical containers, such as cans, one at a time from a carton containing three or more layers of containers. It is a further object of this invention to develop a dispenser that can be easily opened, but provide some resistance to being completely torn open allowing all of the containers to roll out. It is a further object to develop a dispenser for a carton that has openings to allow the consumer to view some of the containers and the printed material on them through one or more openings. Another object of this invention is to develop a dispenser which is easy to commence opening, but would provide some resistance to further tearing.

Briefly described, in its preferred form, the objects of this invention are achieved by providing a carton for carrying cylindrical containers in at least three layers for dispensing the containers one at a time from the exiting end of the carton. The carton is generally rectangular and has a bottom, top, two side panels, a closed end and an exiting end. The carton is foldably constructed from a blank having panels and flaps. The exiting end of the carton is preferable closed by two end flaps, each of which is attached to a side panel. An opening is provided between the top of the two end flaps when they are closed and the top panel. This opening must be significantly smaller than the containers contained to prevent them from falling out of the carton. An arcuate opening is provided in each side panel adjacent the exiting end of the carton and the top panel. It is preferred that the side panels extend beyond the ends of the top and bottom panels.

A tear line is provided that extends from each arcuate opening in each side panel adjacent the exiting end and the top panel, with these tear lines converging towards each other and extending towards the bottom panel so as to form a dispensing flap that may be opened for dispensing the cylindrical containers one at a time.

A new and unique method of opening this dispenser is provided in that when the carton is loaded with cans the ends of one can will be aligned between the arcuate openings in each side panel adjacent the exiting end of the carton and the top panel. A person can start the tearing of the tear lines forming the dispensing flap by simply grasping the ends of the container between the arcuate openings in each side panel and pulling the container forward and upward which commences tearing of the tear lines.

In its preferred form, these tear lines have a zigzag configuration with interspersed interruptions in at least a portion of each tear line so that the tear lines resist tearing under the normal stresses imposed on a carton loaded with containers. Each zigzag tear line is similar to a set of stairs composed of sets of a step and a riser with the interruption in the riser and the clean cut line in the step.

These converging tear lines may turn and extend as a regular tear line or a tear line with perforations to a bottom fold line so that the dispenser flap when fully opened can be folded along the fold line and placed adjacent to the bottom portion of the exiting end of the carton. This bottom fold line of the dispenser flap is preferable placed at a location between 115 and 150 percent of the diameter of a container to be contained in the carton.

This carton may have a bottom opening between the bottom of the end flaps when they are closed and the bottom panel with an adjacent arcuate opening on each side panel to make the containers in the carton more visible. The non-exiting end of the carton is preferable closed by end flaps, and preferable has a top and bottom opening and adjacent arcuate openings in each side panel similar to or identical to the top and bottom openings and arcuate openings in the exiting end of the carton. These openings also serve the purpose of reducing the amount of paperboard used to construct the carton.

As many beverage cans frequently have a bottom end of a slightly different shape and size than the top end, two parallel fold lines may be provided between the end flaps and side panels against which the bottoms of the cans are adjacent to facilitate folding the end flaps attached to this side panel.

This carton may have a handle formed in the top panel. It is preferable that a slotted handle formed by two flaps with a slit in between that extends across the top panel and into the sidewalls be used.

These and other objects, features, and advantages of the present invention will become more apparent upon reading the following specification in conjunction with the accompanying drawing figures.

DETAILED DESCRIPTION OF THE PREFERRED EMBODIMENT

The present invention is intended primarily for use with cans, and other types of cylindrical containers, used to contain soft drinks, beer and the like.

Figure 1:
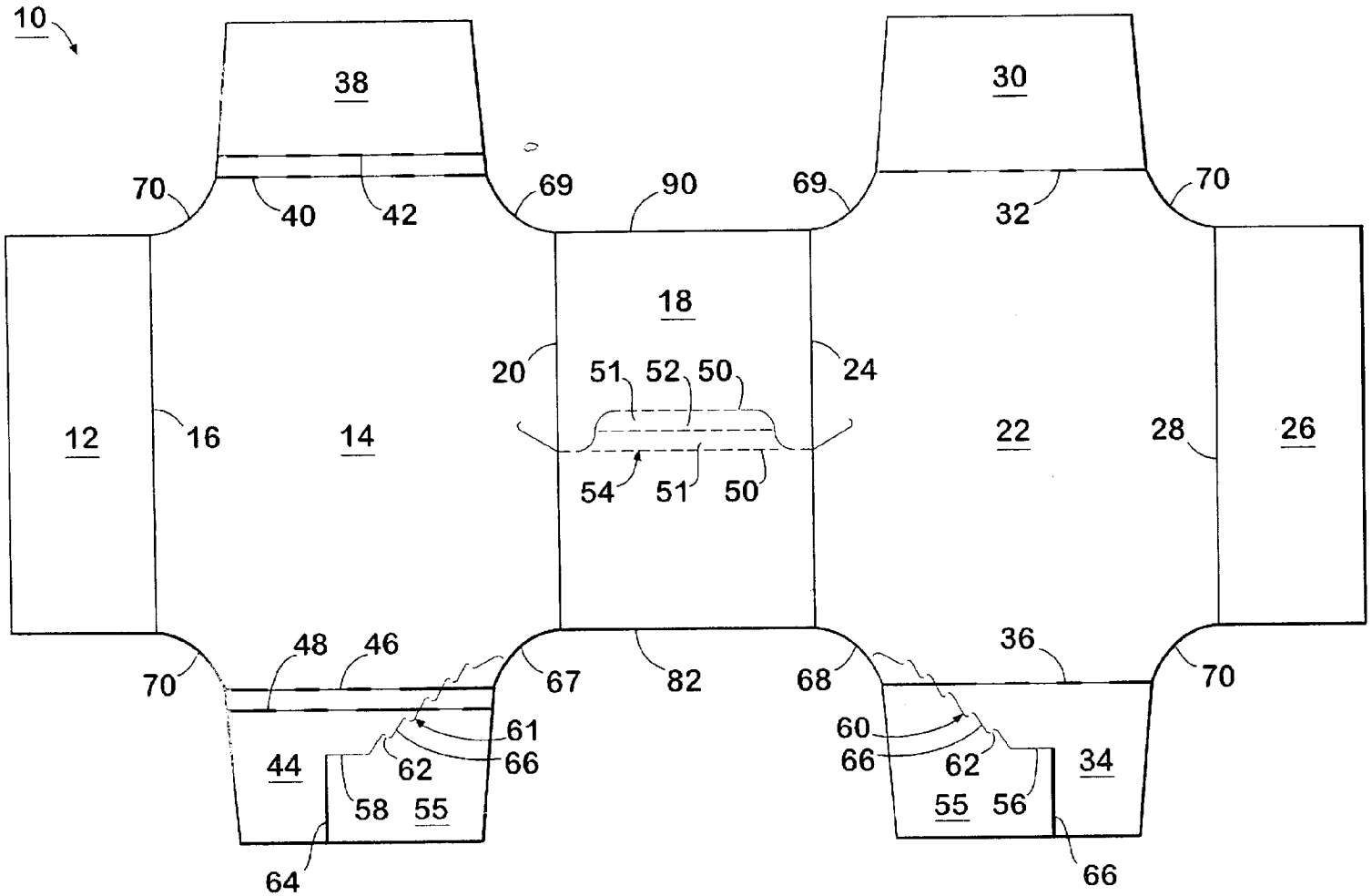
FIG. 1. is a plan view of a blank from which a carton of one embodiment of the invention is formed.

According to a preferred embodiment of the invention, the cans are packaged in a carton that is fully enclosed, except for openings in both ends at the top and bottom. The blank for forming this carton is illustrated in FIG. 1. The blank 10 is formed from a foldable sheet of material, such as paperboard. The blank 10 has a bottom flap 12 that is foldable connected to a bottom side panel 14 by fold line 16, and in turn connected to top panel 18 by fold line 20. The top panel 18 is connected to top side panel 22 by fold line 24, which in turn is connected to bottom flap 26 by fold line 28.

The blank 10 has a top side panel 22 that is connected to end flap 30 by fold line 32, and in turn connected to exiting end flap 34 by fold line 36. Bottom side panel 14 is connected to end flap 38 by fold lines 40 and 42, and in turn connected to exiting end flap 44 by fold lines 46 and 48. A slotted handle 54 is formed in top panel 18 by fold lines 50 which forms two handle flaps 51 which are separated by a handle tear line 52 which may be extended into bottom side panel 14 and top side panel 22 to dissipate the stress imposed in carrying the carton by the slotted handle 54.

Exiting end flaps 34 and 44 have a dispenser flap 55 which is connected to the rest of the carton by tear lines 56 and 58, which may be complete tear lines or perforated tear lines. Zigzag tear line 60 extends from the curved end edge 68 of the top side panel 22 until the zigzag tear line 60 reaches tear line 56. Zigzag tear line 61 extends from the curved end edge 67 of bottom side panel 14 until the zigzag tear line 61 reaches tear line 58. Zigzag tear lines 60 and 61 may have lands or interruptions 62, whose purpose will be explained below. The dispenser flap 55 may have fold lines 64 and 66 connecting it to exiting end flaps 44 and 34, respectively.

In the preferred embodiment of this invention there may be curved end edges 69 in the top of bottom side panel 14 and top side panel 22 adjacent end flaps 38 and 30. There also may be curved end edges 70 on each end of bottom side panel 14 and top side panel 22 adjacent to bottom flaps 12 and 26 respectively.

It will be understood by those skilled in the art that the carton of the present invention is generally symmetrical about a horizontal line of bi-section, as viewed when FIG. 1 is rotated lengthwise. This symmetry aids in the efficient production of the present carton.

Figure 2:
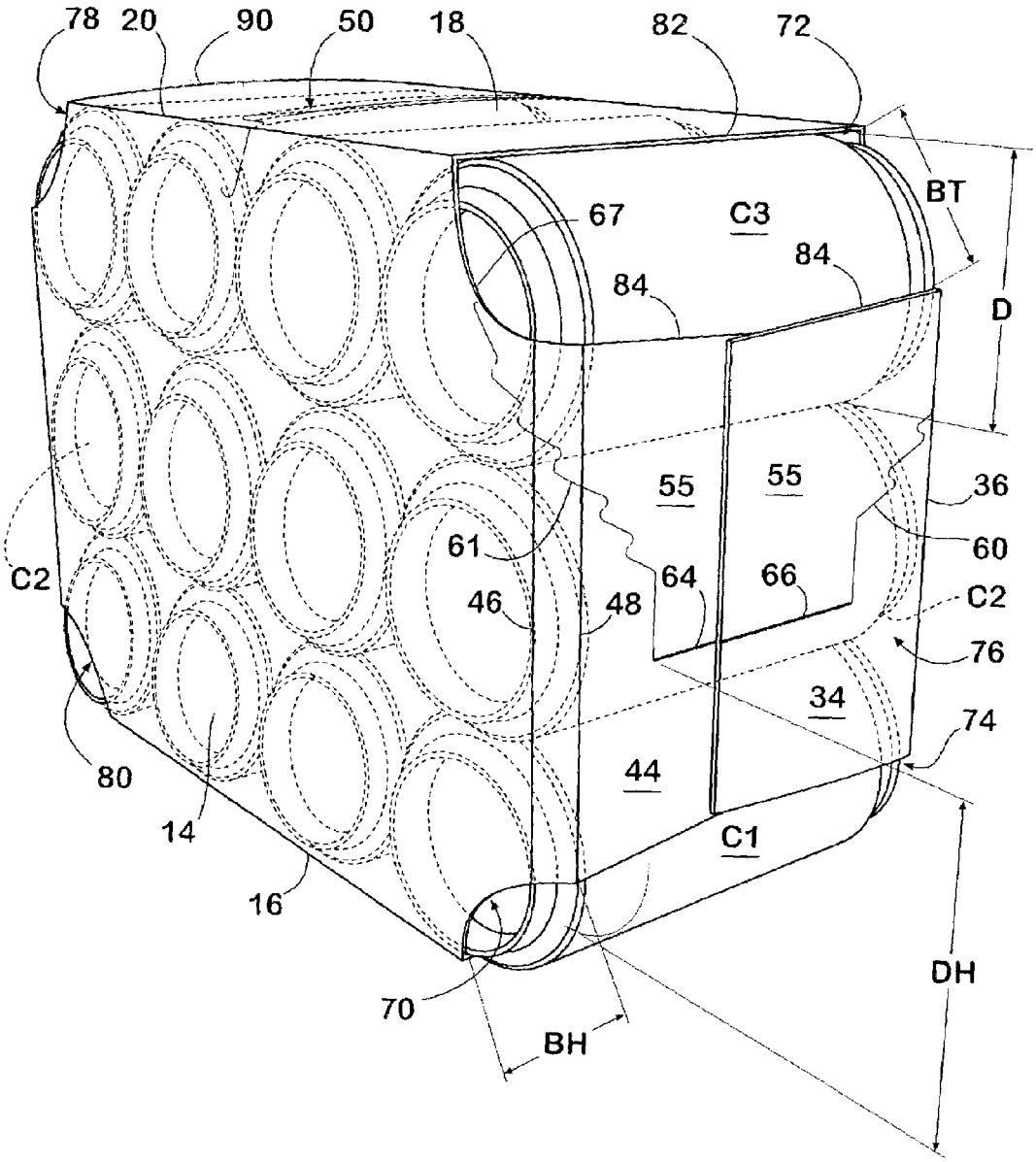
FIG. 2 is a perspective end view of a carton formed from the blank of FIG. 1 and loaded with cans.

In forming this blank 10 into a carton, the blank is folded along fold lines 16, 20, 24, and 28 and bottom flap 12 is glued to bottom flap 26 forming a carton sleeve. Cans C can then be loaded into the carton sleeve. This carton is designed to hold 12 cans, or other types of cylindrical containers, in three layers of four cans in each layer. It should be understood that a carton can be constructed utilizing the features of this invention that can carry more than four cans in each layer and have more than three layers. The cans C are inserted into the carton sleeve with the bottoms of the cans being adjacent to bottom side panel 14. The manner in which the cans C are contained in the carton formed from the blank of FIG. 1 is best illustrated in FIG. 2. Once the cans have been inserted end flaps 30 and 38 can be folded and glued together. Exiting end flaps 34 and 44 can be folded and glued together thus finishing the loading of the carton with cans C.

It will be noticed that there are two fold lines 40 and 42 between bottom side panel 14 and end flap 38 and two fold lines 46 and 48 between bottom side panel 14 and exiting end flap 44. Two fold lines on each end of bottom side panel 14 are preferred to accommodate the dimensions of the bottoms of the cans C. This facilitates the folding of end flap 38 and exiting end flap 44. However, it should be realized that a single fold line may also be used when appropriate, depending on the configuration of the bottom of the cans being placed in the carton.

This carton has a slotted handle 54, but it should be realized that this carton could be constructed without a handle or another type of handle may be used. While bottom flaps 12 and 26 are preferably glued together to form a carton sleeve, they could be joined together by mechanical locks that are known in the art.

It is preferred that there is a top opening 72 and bottom opening 74 on the exiting end 76 of the carton as shown in FIG. 2. An identical top opening 78 and bottom opening 80 may be provided on the non-exiting end of the carton. Top openings 72 and 78 must have a height that is significantly less than the diameter D of a can. The height BT between the front edge 82 of top panel 18 and the top edge 84 of exiting end flaps 34 and 44 must be significantly less than the diameter D of the cans contained in the carton. Preferable this aperture should have a height BT that permits the labeling and logos on the cans C to be visible. It is preferred that the distance BT be between approximately 40 and 70 percent of the diameter D of the cans C so that the cans do not fall out of the carton through top opening 72 when subjected to the normal stresses of carrying and handling the carton. The dimensions of the other openings 74, 78, and 80 are preferably the same as top opening 72.

Figure 4:
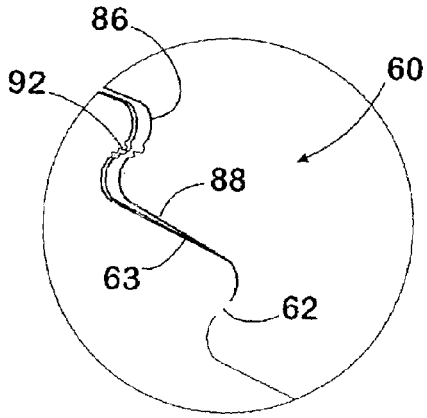
FIG. 4 is an enlarged view of a section of the tear line between the dispenser flap and the rest of the carton taken from FIG. 3.

A zigzag tear line 61 extends from curved edge 67 through bottom side panel 14 and into exiting end flap 44. A zigzag tear line 60 extends from curved edge 68 through top side panel 22 and into exiting end flap 34. While it is preferred to use zigzag tear lines 60 and 61, it should be realized that an ordinary tear line which may be straight with interruptions or lands in the tear line may be utilized. These zigzag tear lines 60 and 61 have a series of cuts 63 and interruptions or lands 62 to prevent the uncontrolled tearing of zigzag tear lines 60 and 61 when the dispenser flap 55 is being opened as shown in FIG. 4. Preferable these zigzag tear lines 60 and 61 are constructed in the format of stair steps which have a step 88 and a riser 86 as illustrated in FIG. 4. A land or interruption 62 may be formed in the riser 86 while a cut line 63 may be formed in the step 88. It is preferred that zigzag tear lines 60 and 61 turn into regular tear lines or perforated lines 56 or 58 until they reach fold line 64 or 66, as the case may be. While it is preferred that the dispenser flap 55 have fold lines 64 and 66, they may be omitted in some cases.

Figure 3:
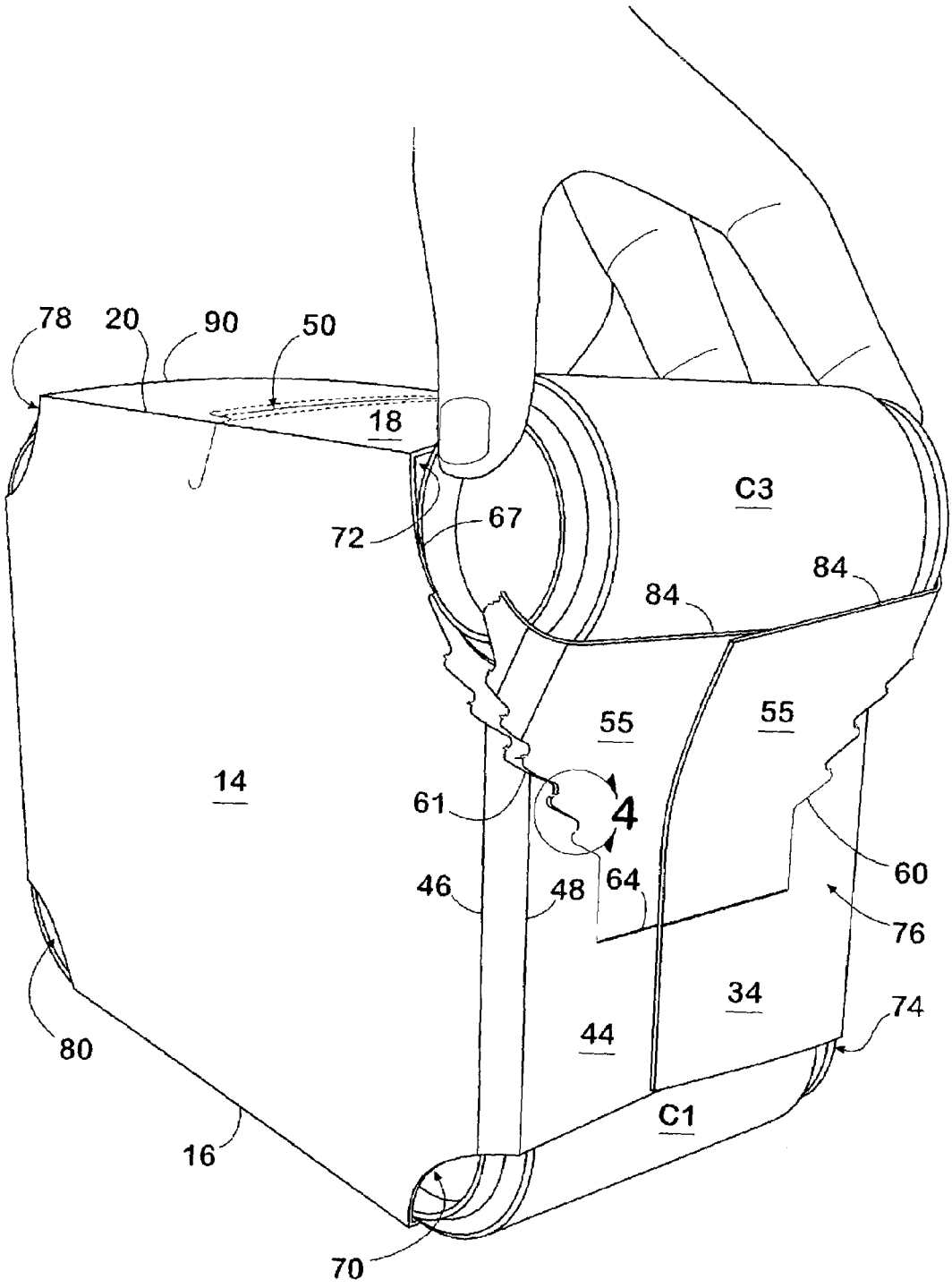
FIG. 3 is a perspective end view of the carton of FIG. 2 in which a person is commencing to remove a can and in the process of commencing tearing the tear lines which commences opening the dispenser flap.

A can C may be removed from the carton by a person grasping the ends of the can 63 and pulling the can upward or forward as illustrated in FIG. 3. The curved or arcuate edge 67 and 68 of bottom side panel 14 and top side panel 22 respectively, facilitate a person grasping the ends of the can C. In order to form these curved edges 67 and 68 and to provide a significant distance BT between the top edge 84 of exiting end flaps 34 and 44 and the edge of the top panel 82, it is preferred that the distance from the top edge 82 of the top panel 18 and the non-exiting edge 90 be significantly less than the distance between fold lines 40 and 46 in bottom side panel 14. The same relationship is also true between top side panel 22 and top panel 18.

When a person grasps the end of the can C3 as illustrated in FIG. 3 and pulls upward or forward, this motion serves the function of commencing the tearing of zigzag tear lines 60 and 61. The can C3 provides extra mass and leverage for commencing the tearing of the zigzag tear lines 60 and 61 which could be hard to tear by a person only grasping the dispenser flap 55 and attempting to tear it. The zigzag tear lines 60 and 61 with it risers 86 and steps 88 and lands or interruptions 62 provides some resistance to the uncontrolled tearing of lines 60 and 61. It is important that lands or interruptions 62 be placed at least in the zigzag tear lines 60 and 61 adjacent curved edges 67 and 68. The uncontrolled tearing of zigzag lines 60 and 61 and tear lines 56 or 58 could result in the complete severing of exiting end 76 allowing many of the cans to roll out of the carton at one time. After the can C3 on the top layer of cans has been removed, the dispenser flap 55 can be torn down to fold lines 64 and 66 so that it is positioned adjacent to bottom of the exiting end 76 of the carton. It should be realized that in the absence of fold lines 64 and 66, the dispenser flap 55 will have a tendency to naturally fold in the location of those tear lines.

It should be realized that the can C3 in the top layer of cans serves the function of an opening device which can be grasped by its ends and start opening the dispenser flap 55. Once the dispenser flap 55 is partially opened, a person can grasp the dispenser flap 55 and finish the desired tearing. While it is preferred that the lands or interruptions 62 be in the riser 86 and the cut line 63 be in the step 88 of the zigzag tear lines 60 and 61, the position of the cut 63 and land or interruption 62 could be reversed. It is preferred that the zigzag tear lines 60 and 61 be constructed to provide resistance to tearing during the normal handling and carrying of the carton filled with cans. The placing of the lands or interruption 62 and the cut lines 63 and the manner in which zigzag tear lines 60 and 61 are configured depends upon a number of factors, such as the caliber of the paperboard of which the carton is formed and the weight and size of the cans C and the handling and carrying conditions anticipated.

Figure 5:
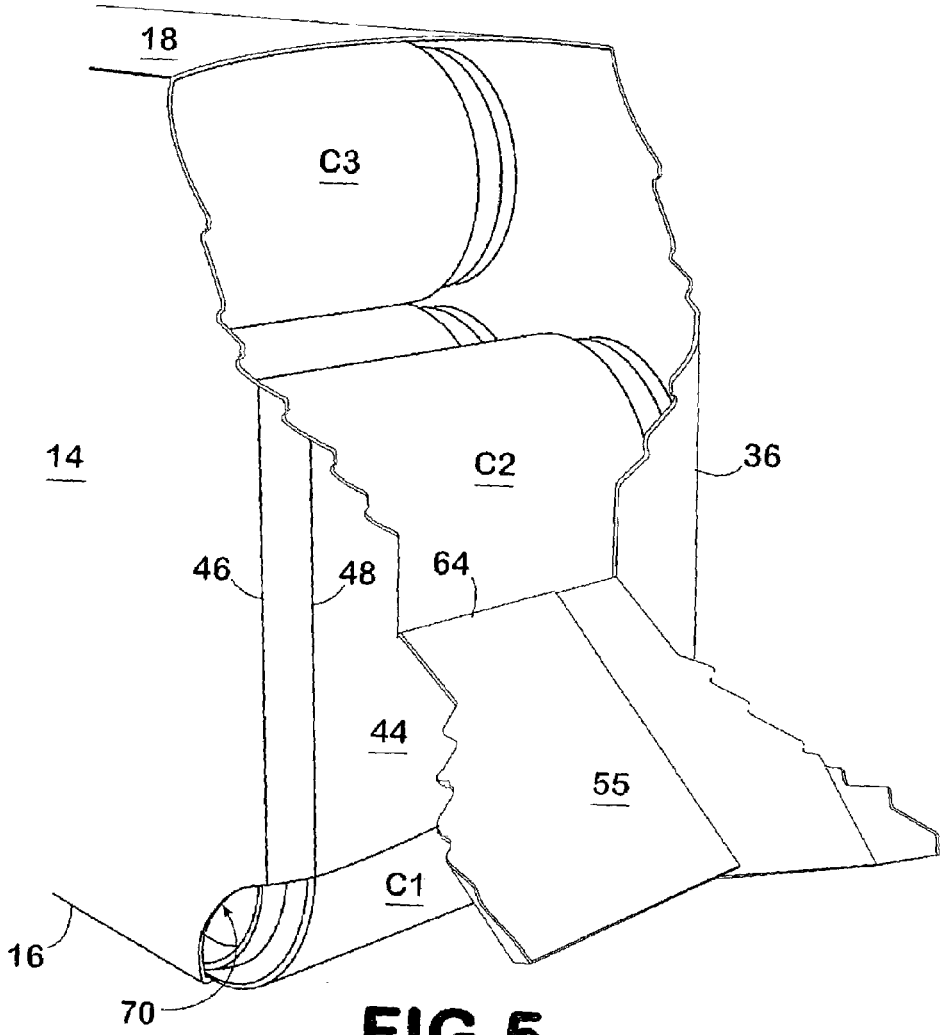
FIG. 5 is a perspective end view of the carton of FIG. 3 in which the can in the top layer has been removed and the dispenser flap torn open and folded downward along its bottom fold line.

The can C2 in the second row as illustrated in FIG. 5 can easily be removed by reaching into the carton and removing it. The can C1 in the bottom layer can be removed by reaching into the carton and removing the can or tilting the carton towards the exiting end 76 and letting it roll out of the opening formed by the removal of the dispenser flap 55.

This carton preferable has a bottom opening 74 and may have top opening 78 and bottom open 80 on the non-exiting end of the carton. All of these openings are preferably of the same size and configuration. These openings must be significantly less than the diameter D of the cans contained in the carton as illustrated by the height BT of the top end opening 72. The height BH of the bottom opening 74 on the exiting end 76 of the carton 76 is BH is preferably the same as BT.

While it is preferred that this carton have bottom opening 74 in the exiting end 76, it should be realized that this opening could be omitted. Top opening 78 and bottom opening 80 on the non-exiting end could also be omitted. It is preferred the carton have four openings 72, 74, 78 and 80 in order to save paperboard and display the labels and logos on the can to the consumer. It is preferred that there only be a dispenser in one end of the carton, but a dispenser could be provided in both ends. A carton embodying the features of this invention can be made to carry more cans than 12 by constructing it to carry four or more layers of cans of two or more cans in each layer.

The height DH of the fold line 64 and 66 from bottom flaps 12 and 26 is preferable from 110 to 150 percent of the diameter D of the can in order for the dispenser to operate conveniently. While the carton shown in FIG. 2 has two end flaps 34 and 44 on the exiting end 76 and 30 and 38 on the other end, it should be understood that each end could be constructed as a single panel.

As illustrated in FIGS. 2 and 3 the opening formed by curved end edges 67 and 68 and top opening 72 should be sufficient for a person's fingers to grasp the ends of a can and remove it resulting in tearing of zigzag tear lines 60 and 61 in the process and thus commencing opening the dispenser flap 55. If the openings formed by curved end edges 67 and 68 formed in bottom side panel 14 and top side panel 22 are of sufficient size and the paperboard is a lower strength, it may be feasible to construct the carton without top end opening 72 or make it much smaller than the diameter D of a can C that the carton is designed to hold. However, it is preferred that top end opening 72 be used and the distance BT between top edge 84 of exiting end flaps 34 and 44 and the edge 82 of top panel 18 not be too small, but significantly less than the diameter D of a can C.

UNIQUE FEATURES OF THE DISPENSER AND CARTON OF THIS INVENTION

One of the unique features of the dispenser of this invention is that it utilizes the can in the top layer of cans in the carton to be grasped and utilizes the leverage and mass provided by the can to start the tearing of the tear lines to form the dispenser flap. This carton is unique in that it has an opening at the top and bottom of both the exiting and non-exiting end of the carton. Zigzag tear lines with interruptions or lands in the riser and a tear or cut line in the step to allow the controlled tearing open of the dispenser flap are preferred.

While the invention has been disclosed in its preferred forms, it will be apparent to those skilled in the art that many modifications, additions, and deletions can be made therein without departing from the spirit and scope of the invention and its equivalents as set forth in the following claims.

What is claimed:

1. A carton for carrying twelve cans in three layers of four cans in each layer, with each can having a diameter and a top end and bottom end, the carton comprising;

(a) a bottom panel, a top panel, said top and bottom panels being interconnected by adjoining side panels, said ends of said cans to be contained in the carton being adjacent said side panels, said carton having two ends, with an end flap attached to each end of each side panel, said end flaps on each end of the carton being adhered together by glue;

(b) with said end flaps on each end of the carton having a top and bottom, with a top opening formed between the top of said end flaps on each end of the carton and said top panel, and a bottom opening formed between the bottom of said end flaps on each end of the carton and said bottom panel, each said opening being significantly smaller than the cans to be contained in the carton, each said side panel extending beyond the ends of said top and bottom panel with an arcuate opening in each side panel adjacent each end of the carton and the top panel and an arcuate opening in each side panel adjacent each end of the carton and the bottom panel; and (c) a tear line extending from each said arcuate opening in each side panel adjacent one end of the carton and the top panel; said tear lines converging toward each other and extending towards said bottom panel so as to form a dispensing flap that may at least be partially torn open by a person grasping the ends of a container adjacent said top opening through said arcuate openings, said tear lines having a zigzag configuration interspersed by interruptions in at least a portion of said tear lines so that the tear lines resist tearing when the carton is loaded with cans and subjected to the normal stresses imposed in carrying a carton loaded with cans.

2. A carton and a plurality of containers within the carton, the containers being arranged in at least three layers with a plurality of containers in each layer, with each container having two ends, a side wall connecting the two ends, and at least one diameter, the carton comprising:

a bottom panel having a bottom panel exiting end;

a top panel having a top panel exiting end;

a first side panel having a first side panel exiting end;

a second side panel having a second side panel exiting end, the top and bottom panels being adjacent to the first and second side panels;

an exiting end panel having a first side connected to the first side panel exiting end, a second side connected to the second side panel exiting end, a top, and a bottom;

a top end opening at least partially defined by the top of the exiting end panel and the top panel exiting end a first top side opening adjacent to the first side panel exiting end and the top panel exiting end;

a second top side opening adjacent to the second side panel exiting end and the top panel exiting end;

the first and second top side openings being of sufficient size to permit a person to grasp the ends of a container adjacent to the top side openings;

a first tear line extending from the first top side opening into the exiting end panel; and a second tear line extending from the second top side opening into the exiting end panel, wherein the first and second tear lines converge toward each other and extend toward the bottom of the exiting end panel to at least partially form a dispensing flap, wherein the dispensing flap may be at least partially torn open by grasping and pulling an adjacent one of the containers.

3. The carton and a plurality of containers of claim 2, wherein pulling a first container out of the carton causes at least partial tearing of the tear lines, permitting a person to remove the containers from the carton.

4. The carton and plurality of containers of claim 2, wherein the first and second tear lines extend downwardly a sufficient distance towards the bottom of the exiting end panel to permit a person to grasp and remove a container in the layer above a bottom layer of the containers when the dispenser flap is fully open.

5. The carton and plurality of containers of claim 2, wherein the top end opening is continuous with the first and second top side openings.

6. The carton and plurality of containers of claim 2, wherein the first side panel exiting end and the second side panel exiting end extend toward the exiting end panel beyond the top panel exiting end.

7. The carton and plurality of containers of claim 6, wherein the top of the exiting end panel does not extend upwardly to a plane wherein the top panel lies.

8. The carton and plurality of containers of claim 2, wherein the top of the exiting end panel does not extend upwardly to a plane wherein the top panel lies.

9. The carton and plurality of containers of claim 2, wherein the top end opening extends a distance from the top panel exiting end to the top of the exiting end panel that is significantly less than the at least one diameter of the containers so as to prevent a container from automatically rolling out of the top end opening.

10. The carton and plurality of containers of claim 9, wherein the first side panel exiting end and the second side panel exiting end extend toward the exiting end panel beyond the top panel exiting end.

11. The carton and plurality of containers of claim 9, wherein the top of the exiting end panel does not extend to a plane wherein the top panel lies.

12. The carton and plurality of containers of claim 9, wherein the first tear line is of a zigzag configuration interspersed by a plurality of interruptions in at least a portion of the first tear line.

13. The carton and plurality of containers of claim 2, wherein the first tear line is of a zigzag configuration interspersed by a plurality of interruptions in at least a portion of the first tear line.

14. The carton and plurality of containers of claim 13, wherein the second tear line is of a zigzag configuration interspersed by a plurality of interruptions in at least a portion of the second tear line nearest the top panel exiting end.

15. The carton and plurality of containers of claim 14, wherein a fold line in the exiting end panel connects ends of the first and second tear lines.

16. The carton and plurality of containers of claim 15, wherein a converging portion of the first tear line is connected to a substantially vertical portion of the first tear line, with the substantially vertical portion having no significant interruptions extending to the fold line in the exiting end panel.

17. The carton and plurality of containers of claim 15, wherein the fold line is approximately a distance of 115 to 150 percent of the at least one diameter of the containers from the bottom panel.

18. The carton and plurality of containers of claim 13, wherein the first and second tear lines end a significant distance from the bottom of the exiting end panel.

19. The carton and plurality of containers of claim 12, wherein a bottom end opening is at least partially defined by the bottom of the exiting end panel and the bottom panel exiting end.

20. The carton and plurality of containers of claim 19, wherein a distance between the bottom of the exiting end panel and the exiting end of the bottom panel is significantly less than the at least one diameter of the containers so as to prevent containers from falling out of the bottom end opening.

21. The carton and plurality of containers of claim 20, further comprising:

a first bottom side opening in the first side panel exiting end adjacent to the bottom panel; and a second bottom side opening in the second side panel exiting end adjacent to the bottom panel.

22. The carton and plurality of containers of claim 2, wherein the exiting end panel comprises a first flap and a second flap.

23. The carton and plurality of containers of claim 22, wherein the first flap is foldably connected to the first side panel and the second flap in foldably connected to the second side panel.

24. The carton and plurality of containers of claim 23, wherein a bottom end opening is formed between the bottom of the exiting end panel and the exiting end of the bottom panel, wherein a distance between the bottom of the exiting end panel and the exiting end of the bottom panel is significantly less than the at least one diameter of the containers so as to prevent containers from falling out of the bottom end opening.

25. The carton and plurality of containers of claim 24, further comprising:

a first bottom side opening in the first side panel exiting end adjacent to the bottom panel; and a second bottom side opening in the second side panel exiting end adjacent to the bottom panel.

26. The carton and plurality of containers of claim 22, further comprising a pair of parallel fold lines extending between the first side panel and the first flap.

27. The carton and plurality of containers of claim 2, further comprising an end panel disposed at a non-exiting end of the carton and means to close the non-exiting end.

28. The carton and plurality of containers of claim 27, further comprising a top non-exiting end opening adjacent to a top of the non-exiting end panel and the top panel.

29. The carton and plurality of containers of claim 28, further comprising a bottom non-exiting end opening adjacent to a bottom of the non-exiting end panel and the bottom panel, the bottom non-exiting end opening extending a distance between the non-exiting end panel and the bottom panel that is significantly less than the at least one diameter of the containers.

30. The carton and plurality of containers of claim 2, further comprising a handle.

31. A carton and a plurality of containers within the carton, the containers being arranged in at least two layers with a plurality of containers in each layer, with each container having two ends, and a side wall having at least one diameter, the carton comprising:

a bottom panel;

a top panel having a top panel exiting end;

a first side panel having a first side panel exiting end;

a second side panel having a second side panel exiting end, the top and bottom panels being adjacent to the first and second panels, an exiting end panel having a first side connected to the first aide panel exiting end, a second side connected to the second side panel exiting end, a top, and a bottom;

a top end opening at least partially defined by the top of the exiting end panel and the top panel exiting end;

a first top side opening extending into the first side panel and into the top panel;

a second top side opening extending into the second side panel into the top panel;

a first tear line extending from the first top side opening into the exiting end panel; and a second tear line extending from the second top side opening into the exiting end panel, wherein the first and second tear lines converge towards one another to at least partially from a dispensing flap.

32. The carton and plurality of containers of claim 31, wherein the first tear line is of a zigzag configuration interspersed by a plurality of interruptions at least in a portion of the first tear line.

33. The carton and plurality of containers of claim 32, wherein the second tear line is of a zigzag configuration interspersed by a plurality of interruptions at least in a portion of the second tear line nearest the top panel exiting end.

34. The carton and plurality of containers of claim 33, wherein the top end opening is smaller than the containers.

35. The carton and plurality of containers of claim 34, wherein a bottom end opening Is at least partially defined by the bottom of the exiting end panel and the exiting end of the bottom panel.

36. The carton and plurality of containers of claim 32, wherein the first tear line comprises a series of stair steps, each stair step having a step and a riser portion, at least some of the stair steps having a tear line portion.

37. The carton and plurality of containers of claim 36, wherein the first tear line comprises at least some interruptions in the riser portions.

38. The carton and plurality of containers of claim 31, wherein the exiting end panel comprises a first flap and a second flap.

39. The carton and plurality of containers of claim 38, wherein the first flap is foldably connected to the first side panel and the second flap is foldably connected to the second side panel.

40. The carton and plurality of containers of claim 31, further comprising:

an end panel disposed at a non-exiting end of the carton; and means to close the non-exiting end.

41. The carton and plurality of containers of claim 40, further comprising a top non-exiting end opening adjacent to a top of the non-exiting end panel and the top panel.

42. The carton and plurality of containers of claim 40, further comprising a bottom non-exiting end opening adjacent to a bottom of the non-exiting end panel and the bottom panel.

43. A method of opening a carton, comprising:

providing a carton and a plurality of containers within the carton, the carton comprising:

a bottom panel;

a top panel;

a first side panel;

a second side panel;

an exiting end panel;

at least one opening and at least one tear line at least partially defining a dispensing flap; and grasping one of the containers through the at least one opening and pulling the container from the carton, the pulling also tearing the at least one tear line and opening the dispensing flap.

44. The method of claim 43, wherein the at least one opening comprises:

a first top side opening adjacent to a first side panel exiting end and an exiting end of the top panel; and a second top side opening adjacent to a second side panel exiting end and to the top panel exiting end, the first and second top side openings being of sufficient size to permit a person to grasp opposite ends of at least one of the containers located adjacent to the top side openings.

45. The method of claim 43, wherein the at least one opening further comprises a top end opening that is at least partially defined by an exiting end of the top panel and a top of the exiting end panel.

46. The method of claim 45, wherein the containers have at least one common diameter, and wherein the top end opening extends a distance from the top panel citing end to the top of the exiting end panel that is significantly less than the at least one common diameter so as to prevent a container from automatically rolling out of the top end opening.

47. The method of claim 46, wherein the at least one tear line comprises;

a first tear line of a zigzag configuration interspersed by a plurality of interruptions in at least a portion of the first tear line; and a second tear line of a zigzag configuration interspersed by a plurality of interruptions in at least a portion of the second tear line.

48. The method of claim 47, wherein a fold line connects ends of the first and second tear lines, the fold line being a distance of approximately 115 to 150 percent of the at least one common diameter from the bottom panel.

49. The method of claim 43, wherein grasping one of the containers through the at least one opening comprises grasping opposite ends of one of the containers.

50. The method of claim 43, wherein the containers are generally cylindrical and are arranged in multiple layers with a plurality of containers in each layer.

* * * * *